US009636732B2

(12) United States Patent
Del Fabro

(10) Patent No.: US 9,636,732 B2
(45) Date of Patent: May 2, 2017

(54) BENDING MACHINE FOR METAL PRODUCTS AND CORRESPONDING BENDING METHOD

(71) Applicant: Giorgio Del Fabro, Udine (IT)

(72) Inventor: Giorgio Del Fabro, Udine (IT)

( * ) Notice: Subject to any disclaimer, the term of this patent is extended or adjusted under 35 U.S.C. 154(b) by 0 days.

(21) Appl. No.: 14/650,240

(22) PCT Filed: Dec. 4, 2013

(86) PCT No.: PCT/IB2013/002694

§ 371 (c)(1),
(2) Date: Jun. 5, 2015

(87) PCT Pub. No.: WO2014/087221

PCT Pub. Date: Jun. 12, 2014

(65) Prior Publication Data

US 2015/0314355 A1 Nov. 5, 2015

(30) Foreign Application Priority Data

Dec. 5, 2012 (IT) ..... UD2012A0210

(51) Int. Cl.

| | |
|---|---|
| ***B21D 7/02*** | (2006.01) |
| ***B21D 7/022*** | (2006.01) |
| ***B21C 1/00*** | (2006.01) |
| ***B21D 11/12*** | (2006.01) |

(52) U.S. Cl.

CPC ..... *B21D 7/022* (2013.01); *B21C 1/00* (2013.01); *B21D 11/12* (2013.01)

(58) Field of Classification Search

CPC ..... B21D 11/12; B21D 7/022; B21D 7/0225
USPC ..... 72/331, 338
See application file for complete search history.

(56) References Cited

U.S. PATENT DOCUMENTS

| | | | | |
|---|---|---|---|---|
| 1,771,955 A * | 7/1930 | Fork | ..... | B21D 53/30 72/129 |
| 3,680,347 A | 8/1972 | Schenck et al. | | |
| 2004/0250591 A1 * | 12/2004 | Del Fabro | ..... | B21D 11/12 72/294 |

FOREIGN PATENT DOCUMENTS

| | | | |
|---|---|---|---|
| EP | 1396296 | A1 | 3/2004 |
| WO | WO-03/024640 | A1 | 3/2003 |
| WO | WO-2007/141273 | A1 | 12/2007 |
| WO | WO-2012/143776 | A1 | 10/2012 |

OTHER PUBLICATIONS

Search Report and Written Opinion for PCT/IB2013/002694, mailed Apr. 4, 2014.

* cited by examiner

*Primary Examiner* — Debra Sullivan
(74) *Attorney, Agent, or Firm* — Marshall, Gerstein & Borun LLP

(57) ABSTRACT

Bending machine for one or more metal products such as, for example, bars (11*a*, 11*b*), reinforcement round pieces, structural shapes, tubes or other profiles, comprising at least a bending unit, a main drawing unit, able to draw the bar along an axis of advance toward the bending unit, and a main shearing unit disposed between the bending unit and the main drawing unit. The machine also comprises a secondary drawing or extraction unit disposed between the main drawing unit and the main shearing unit. The secondary drawing or extraction unit is configured and programmed to draw an end portion of bar, exiting from the main drawing unit, along the axis of advance toward the bending unit.

8 Claims, 4 Drawing Sheets

BENDING MACHINE FOR METAL PRODUCTS AND CORRESPONDING BENDING METHOD

FIELD OF THE INVENTION

The present invention concerns a bending machine and the corresponding bending method for metal products such as for example bars, reinforcement round pieces, structural shapes, tubes or other profiles with any section shape whatsoever.

BACKGROUND OF THE INVENTION

Bending machines for metal products such as, for example, bars, reinforcement round pieces, structural shapes, tubes or other profiles, with any section shape whatsoever are known, for shaping stirrups or other shaped reinforcement products. Examples of such bending machines are shown in documents WO 2007/141273 A1, WO 03/24640 A1 and WO 2012/143776 A1, all in the name of the present Applicant.

These machines normally consist of a main drawing unit, for example with rollers, which feeds the bars toward a bending unit, and a shearing unit, for example shears, interposed between the main drawing unit and the bending unit, which shears the shaped bars to take them to the size corresponding to the linear development of the segments to be formed.

Since this linear development, or the length of the starter bar when bars are being worked, does not correspond exactly to the length or an exact sub-multiple of the bars sheared, a terminal segment of the bars, or offcut, remains between the drawing unit and the shears, and requires to be removed before a new work cycle is started.

The offcuts, when they do not fall on their own, must therefore be discharged from the axis of advance of the bars; this happens either manually or by suitable expulsion devices.

The manual solution often entails stopping the machine, lifting the cover and removing the segment, with obvious loss of time and problems in terms of safety for the operator.

There are also automated devices which intervene after the shearing has been carried out so that the offcut is discharged, thus freeing the work axis of the shears and drawing unit. However, there is a risk that the discharged offcut may interfere with the bending unit or with other operating units that can be present on the bending machine, compromising the correct functioning thereof and obliging the operator to intervene in any case.

Furthermore, this solution does not guarantee sufficient safety for the operator, since the offcuts are discharged in an uncontrolled manner and can hit the operator.

Another disadvantage is the quantity and length of the offcuts. In other words, the discard of material to be removed from the work cycle is a considerable cost.

These disadvantages can lead to losses in productivity, even considerable, for example where the segment gets jammed, or can lead to injuries to the operator, for example where the thickness is put in an anomalous and unsafe position.

One purpose of the present invention is to obtain a bending machine for metal products, and a corresponding bending method, which allows to discharge the offcuts quickly, easily and safely.

Another purpose of the present invention is to obtain a bending machine that is able to limit the quantity and length of the offcuts to be discharged.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a bending machine and the corresponding bending method, which overcome the limits of the state of the art and eliminate the defects therein, are used for bending metal products such as for example bars, reinforcement round pieces, structural shapes, tubes or other profiles with any section shape whatsoever.

Hereafter in the description, the word bar shall be understood to include both bars and reinforcement round pieces, structural shapes, tubes or other profiles with any section shape whatsoever.

The bending machine comprises at least a bending unit, a main drawing unit able to make the bars advance along an axis of advance toward the bending unit, and a main shearing unit, for example shears, able to shear the bars to a determinate size to define the semi-worked product exiting.

According to one feature of the present invention, the bending machine also comprises a secondary drawing or extraction unit, disposed between the main drawing unit and the main shearing unit.

Advantageously, the secondary drawing or extraction unit is disposed upstream of the main shearing unit, with respect to the bending unit, in a position near the main shearing unit.

The secondary drawing or extraction unit is configured and programmed to move a terminal portion of bar, exiting from the main drawing unit, along the axis of advance, toward the bending unit.

The presence of the secondary drawing or extraction unit allows to work a part of the bar that it is not possible to work with current solutions, thus limiting offcuts or their length, given that the secondary drawing or extraction unit is positioned immediately upstream of the main shearing unit.

The secondary drawing or extraction unit is also able to take the rear portion of each bar to a position such as to allow it to be discharged automatically, simply by the subsequent bar sent to the shearing and bending cycle: this gives advantages in terms of safety for the operator, who thus does not have to intervene manually to remove the offcuts.

According to the invention, it is the bar subsequently introduced that thrusts and discharges the segment of the first bar advancing after the execution of the bending cycle.

According to a first formulation of the invention, upstream of the main shearing unit, and in cooperation with the secondary drawing unit, a holding pipe is provided for every metal bar that the machine is able to work simultaneously.

According to a variant, the holding pipe has a conformation at least at the end which facilitates the introduction of the metal bar.

According to another variant, the holding pipe cooperates with two opposite rollers of the secondary drawing unit; according to another variant, one or both of said rollers can be motorized. If motorized, in the interval between around the end of the shaped product obtained with the first bar and the introduction of another and successive bar, the rollers expel the segment or offcut, which therefore falls forward.

In other words, when a first bar being bent has its tail-end that has left the main drawing unit, the secondary drawing unit provides to move the bar according to the bending program.

When there are no rollers, the invention provides as a further variant that segment retention means cooperate with the holding pipe; in this case, the arrival of the successive bar expels the segment.

According to another characteristic of the present invention, upstream of the secondary drawing unit a second shearing unit of the bilateral type is provided, which serves to butt the bar, with the possibility of head-wise and/or tail-wise butting.

BRIEF DESCRIPTION OF THE DRAWINGS

These and other characteristics of the present invention will become apparent from the following description of some forms of embodiment, given as a non-restrictive example with reference to the attached drawings wherein.

DETAILED DESCRIPTION OF ONE FORM OF EMBODIMENT

Figure 1:
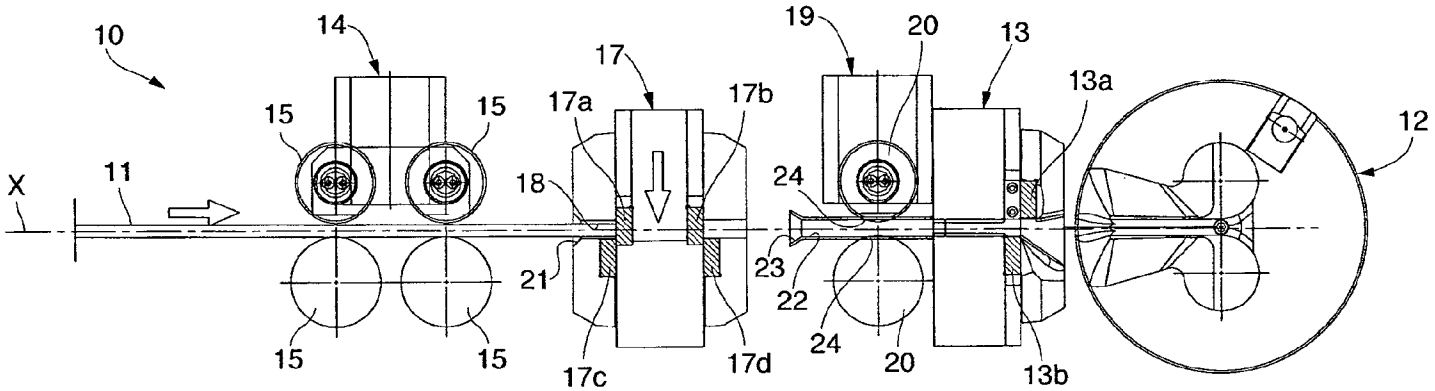
FIGS. 1-7 show schematically a bending machine according to the present invention, during a sequence of working steps.
Figure 2:
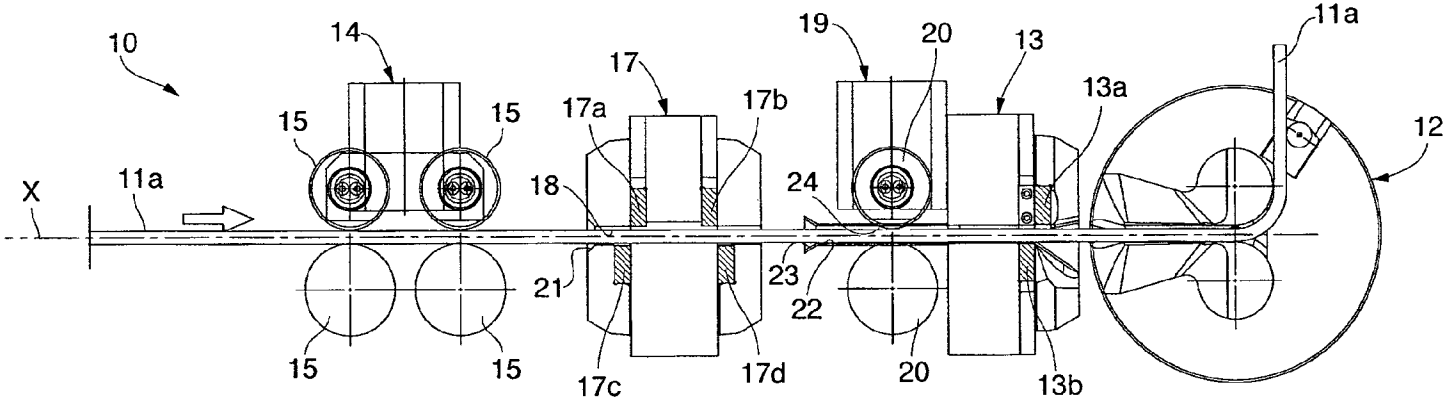
Figure 3:
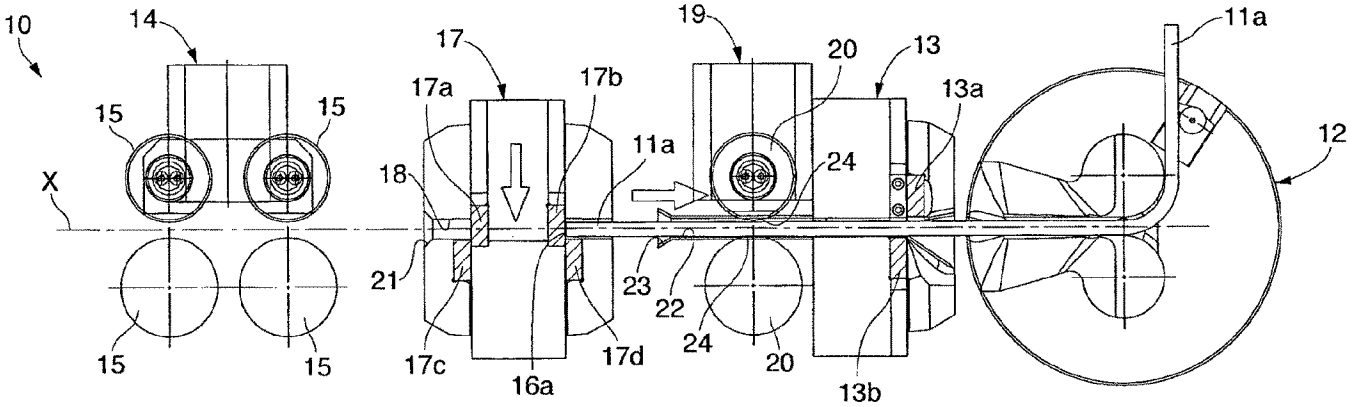
Figure 4:
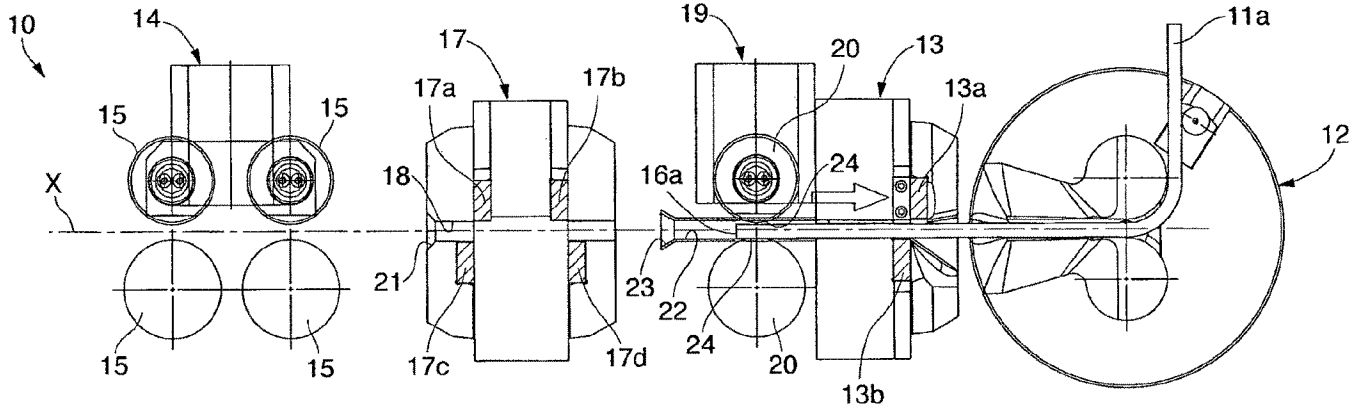
Figure 5:
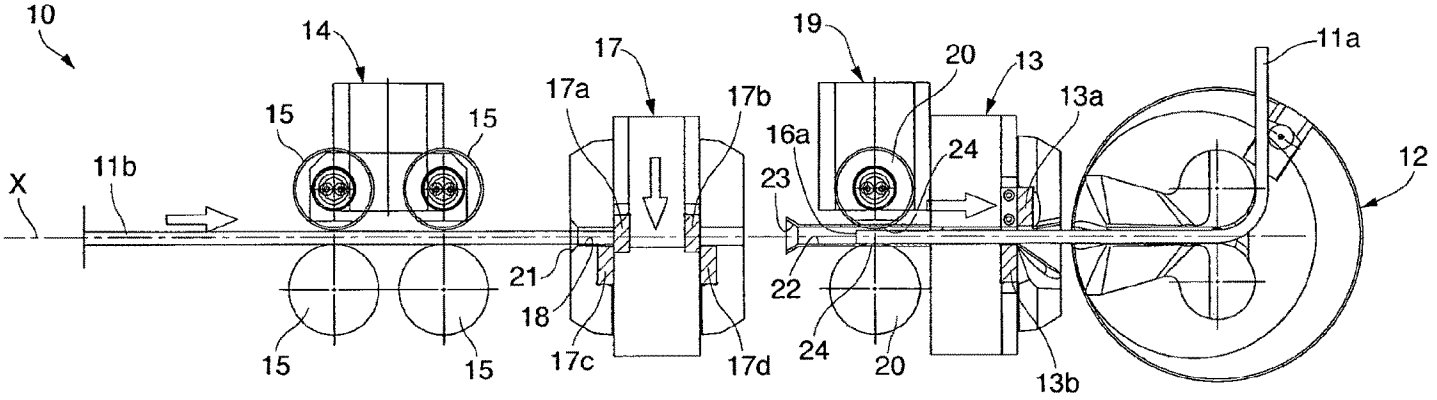
Figure 6:
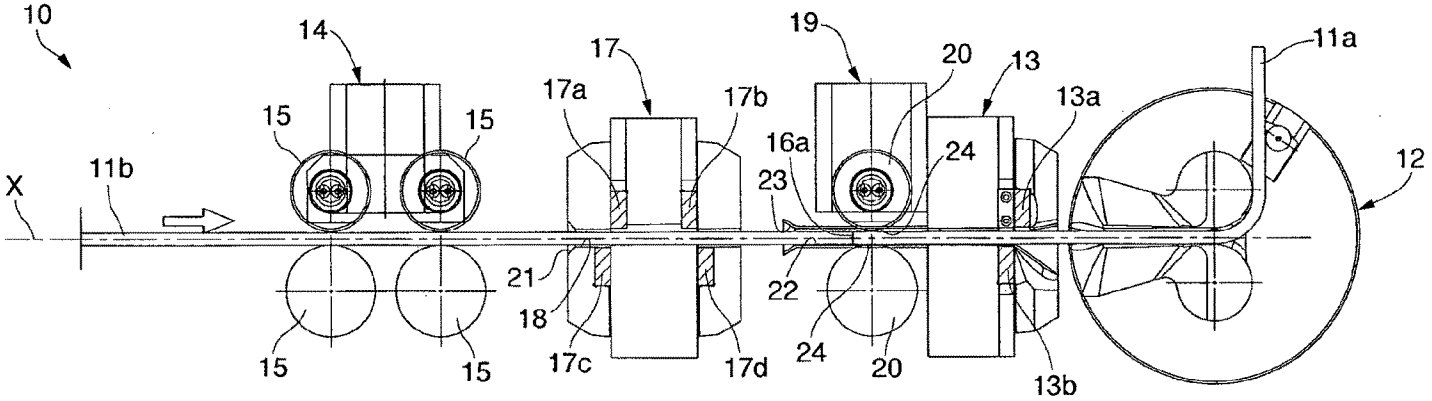
Figure 7:
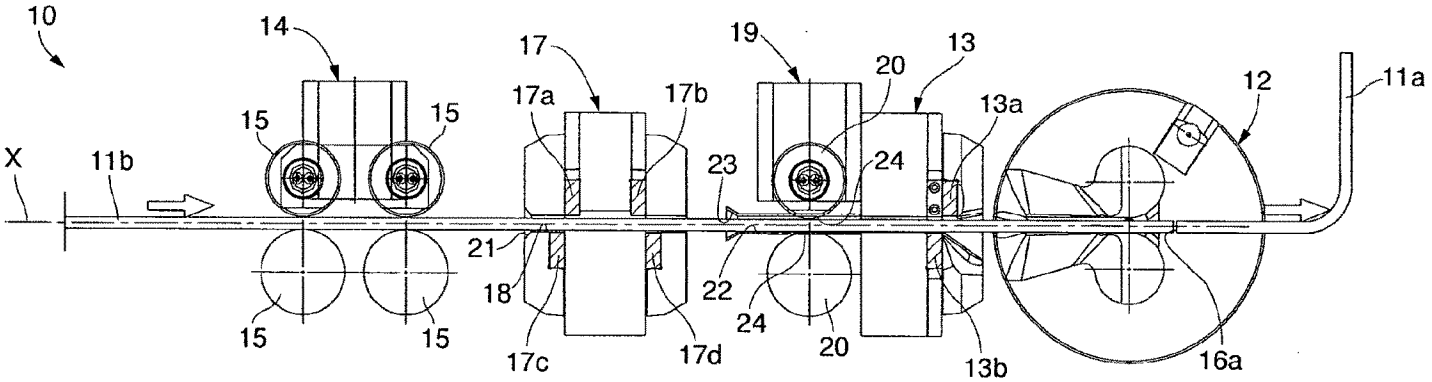
Figure 8:
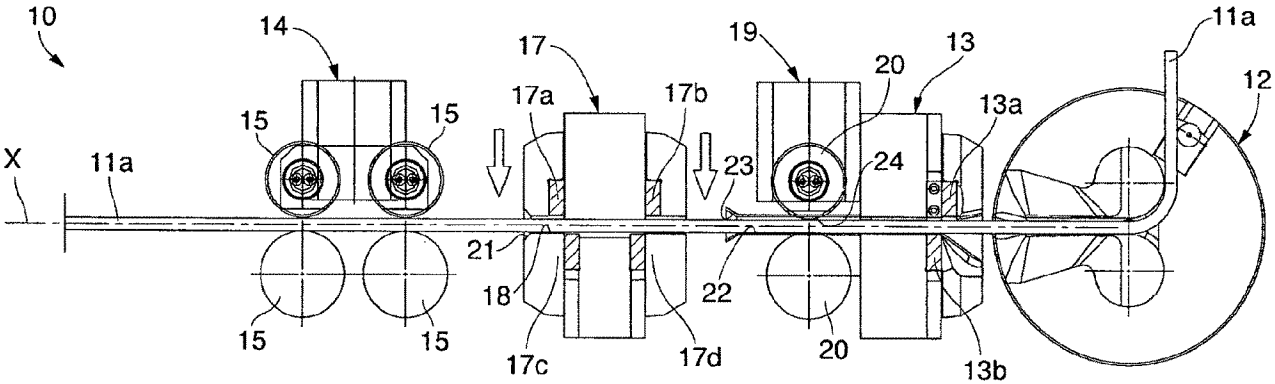
FIG. 8 is a variant of the bending machine in FIGS. 1-7.

With reference to FIGS. 1-7, a bending machine 10, shown only partially, according to the present invention is used for bending metal products such as for example bars, reinforcement round pieces, structural shapes, tubes or other profiles with any section shape whatsoever.

Hereafter in the description, the word bar shall be understood to include both bars and reinforcement round pieces, structural shapes, tubes or other profiles with any section shape whatsoever.

The bending machine 10 is configured so as to selectively work one or more bars simultaneously.

Hereafter in the description, the bars will be identified generically by the reference number 11. Given that the bars 11 are inserted and worked in sequence, one after the other, a first bar introduced will be identified by the reference number 11*a*, while the bar introduced after 11*a* will be identified by the reference number 11*b*.

In this case, the bending machine 10 comprises a bending unit 12, in this case a disc, able to bend one or more bars 11, a main shearing unit or shears 13, disposed upstream of the bending disc 12 and able to finish or rather shear the bent bars 11, eliminating the excess parts thereof with respect to the linear development of the segment formed, and a main drawing unit 14 with pairs of rollers 15, able to make the bars 11 advance along an axis of advance X toward the bending disc 12.

The bending disc 12, the main shears 13 and the main drawing unit 14 can be of any type, which is not restrictive for the purposes of the present invention.

In this case, the main shears 13 comprise an upper blade 13*a* and a lower blade 13*b*, at least one of which is mobile to perform the shearing to the desired size.

According to the invention, the bending machine 10 also comprises, between the main drawing unit 14 and the main shears 13, secondary shears of the bilateral type 17 and a secondary drawing or extraction unit 19. In some forms of embodiment, at least one of either said main drawing unit 14 or said secondary drawing or extraction unit 19 is commanded by a central control and command unit. The secondary drawing or extraction unit 19 is advantageously disposed upstream of the main shears 13, with respect to the bending disc 12, in a position near the main shears 13.

The secondary bilateral shears 17 comprise a first lead-in channel 18 provided with a first truncated cone-shaped inlet 21 able to facilitate the insertion and subsequent advance of the bars 11. The secondary bilateral shears 17 also comprise two upper blades 17*a* and 17*b* associated with respective two lower blades 17*c*, 17*d*, at least one of which, for each pair, is mobile to selectively interfere with the first channel 18. As can be seen in the drawings, in this case the upper blade 17*a* is associated with the lower blade 17*c* and is located on one side of the bilateral shears 17 facing toward the main drawing unit 14, whereas the other upper blade 17*b* is associated with the lower blade 17*d* and is located on the other side of the bilateral shears 17 facing toward the secondary drawing or extraction unit 19.

Using secondary bilateral shears, with two upper blades 17*a* and 17*b* and two respective lower blades 17*c* and 17*d*, allows to use, as will be seen, said blades to perform respectively, one to butt the head-ends of the bars 11, and the other to butt the tail-ends of the same bars 11.

The secondary drawing or extraction unit 19 can comprise thrust means, in this case rollers 20. The secondary drawing or extraction unit 19 is driven at least when the bar 11 is no longer gripped by the main drawing unit 14.

The secondary drawing or extraction unit 19 comprises a second lead-in channel 22 disposed between the rollers 20, which is provided with a truncated cone-shaped inlet 23 which facilitates the alignment and insertion of the bars 11, and with apertures 24 that allow the rollers 20 to cooperate with the bars introduced into the second channel 22.

If there are two or more bars 11 in parallel, there are respectively two or more channels 18 and 22, one for each bar 11, in the secondary bilateral shears 17 and the secondary drawing or extraction unit 19.

The bending machine 10 as described heretofore functions as follows.

In a first step (FIG. 1), the first bar/bars 11*a* is/are introduced in a known manner between the rollers 15 of the main drawing unit 14.

Hereafter in the description we shall refer to two bars 11*a* inserted in a pair, of which only one is visible in the drawings, although the possibility of working one or more than two bars 11*a* is not excluded.

The main drawing unit 14 draws the bars 11*a* along the axis of advance X as far as the bilateral shears 17. In particular, during this step, the first bars 11*a* are butted, that is, the respective head-ends are equalized and aligned, on the upper blade 17*a* of the bilateral shears 17, which is in a low position and thus functions as an abutment surface for the first bars 11*a*. In this way, the bars 11*a* are aligned with their front end.

According to a variant, the butting of the first bars 11*a* can be carried out on one of the blades 13*a* or 13*b* of the main shears 13, in the same way as happens with the bilateral shears 17.

In a second step (FIG. 2), the upper blades 17*a*, 17*b* of the bilateral shears 17 open and the main drawing unit 14 draws the first bars 11*a* to the bending disc 12 by means of which stirrups or other semi-worked shaped products are formed, according to usual work cycles.

During this step, the bars 11*a* are made to pass through the bilateral shears 17 and the secondary drawing or extraction unit 19, without the latter intervening. In particular, the first bars 11*a* pass through the first 18 and second channel 22 which guide them as far as the bending disc 12.

In this step, according to a variant, the secondary drawing or extraction unit 19 can act, if suitably synchronized by means of the command and control unit, in addition to the main drawing unit 14, to provide greater traction to the first bars 11*a*.

Also during this step, the main shears 13 shear the bars 11*a* drawn by the main drawing unit 14, using the upper blades 13*a* and lower blades 13*b*, and according to determinate intervals of time, for example regular, so as to obtain a plurality of semi-worked products, for example all having the same sizes.

In a third step (FIG. 3), the tail or rear end 16*a* of the bars 11*a* exits from the main drawing unit 14, then the bars 11*a* are no longer gripped by the main drawing unit 14. The secondary drawing or extraction unit 19 is then driven, since the main drawing unit 14 is no longer able to draw the first bars 11*a*.

The secondary drawing or extraction unit 19 allows to continue working on the remaining segment of the bars 11*a* between the main shears 13 and the main drawing unit 14.

This allows to limit the quantity and length of the offcuts, which entails a reduction in waste and an economic benefit.

Furthermore, if the distance between the main shears 13 and the main drawing unit 14 is different from the length of one of the semi-worked products previously obtained, it is possible to obtain from the same bending machine 10 at least two types of product, in the sense of products with different lengths.

During the third step, the main shears 13 act in the same way as in the second step.

The secondary drawing or extraction unit 19 takes the tail-ends 16*a* of the first bars 11*a* to a sufficient distance to guarantee they are butted tail-wise on the upper blade 17*b* of the bilateral shears 17, located in a lowered position.

If only one bar 11*a* is being worked, the tail-wise butting is useful so as to know the state of advance of the bar 11*a*.

If two or more bars 11*a* are worked in parallel, the tail-wise butting is necessary for the subsequent steps, as will be described hereafter in the description.

In a fourth step (FIG. 4), the secondary drawing or extraction unit 19 continues drawing the bars 11*a* to a predetermined size. In particular, the fourth step is concluded when the bars 11*a* are stopped in a determinate position in which their tail-ends 16*a* are a little before the secondary drawing or extraction unit 19. At this point, the portion of bar 11*a* remaining defines the offcut to be discharged.

During the fourth step too, the main shears 13 can shear the bars 11*a* to regular segments in order to obtain a plurality of semi-worked products.

In a fifth step (FIG. 5), similar to what we saw before, second bars 11*b* are introduced into the main drawing unit 14 and are butted head-wise on the upper blade 17*a*, which is in a low position, of the bilateral shears 17.

In a sixth step (FIG. 6), the upper blades 17*a* of the bilateral shears 17 open and the main drawing unit 14 draws the second bars 11*b* until they enter into contact with the stationary first bars 11*a*, that is, with the segments thereof to be discharged, unless the machine 10 provides to make small shaped products which can be obtained starting from said segments of first bars 11*a*.

According to a first solution, the fifth and sixth steps are subsequent to the third and fourth steps.

According to a variant, the fifth and sixth steps can take place partly or completely simultaneously with the third and fourth steps, thus obtaining a saving in terms of cycle times.

In a seventh step (FIG. 7), the second bars 11*b* thrust the segments of the first bars 11*a* along the axis of advance X in order to complete the working and possibly to expel the offcuts, which are represented by the final segment of the bars 11*a*.

It is therefore important to perform an adequate tail-wise butting, as in the previous steps, of the bars 11*a* and 11*b*, so that the head-ends of the second bars 11*b* enter into contact with the tail-ends 16*a* of the first bars 11*a* at the same time and at the same height, without misalignment, so as to have a uniform thrust.

Therefore, according to the invention, the offcuts are expelled along the axis of advance X substantially automatically and easily, without interference with the work units of the bending machine 10. Furthermore, manual intervention by the operator is avoided, thus limiting the risk for the operator of suffering injures and/or accidents.

Advantageously, the presence of the secondary drawing or extraction unit 19 allows to make, with the same bending machine 10, stirrups and semi-worked products having different sizes, thus increasing productivity. This is because, as we said, small-size shaped products can be obtained using the segments of bar not gripped even by the secondary drawing or extraction unit 19, obtaining the feed of such segments to the bending disc 12 by thrusting the bars fed for the subsequent work cycle.

This also entails a limit to the offcuts, since the length of the segments of the bars that cannot be worked is reduced.

It is clear that modifications and/or additions of parts may be made to the bending machine 10 and bending method as described heretofore, without departing from the field and scope of the present invention.

It is also clear that, although the present invention has been described with reference to some specific examples, a person of skill in the art shall certainly be able to achieve many other equivalent forms of bending machine and method, having the characteristics as set forth in the claims and hence all coming within the field of protection defined thereby.

The invention claimed is:

1. Bending machine for a metal product, comprising a bending unit, a main drawing unit able to draw said metal product along an axis of advance toward said bending unit, and a main shearing unit disposed between said bending unit and said main drawing unit, said machine also comprising a secondary drawing or extraction unit disposed between said main drawing unit and said main shearing unit, said secondary drawing or extraction unit being configured and programmed to draw an end portion of the metal product exiting from said main drawing unit along said axis of advance toward said bending unit, and further comprising a secondary shearing unit of the bilateral type disposed between said secondary drawing or extraction unit and said main drawing unit, and wherein said secondary shearing unit of the bilateral type comprises a pair of upper blades associated with respective lower blades, wherein a first upper blade is located on one side of the bilateral shears facing toward the main drawing unit, whereas a second upper blade is located on another side of the secondary shearing unit facing toward the secondary drawing or extraction unit.

2. Bending machine as in claim 1, wherein said upper blades are able to interfere with a first guide element for said metal product made in said secondary shearing unit.

3. Bending machine as in claim 1, wherein at least one of either said main drawing unit or said secondary drawing or extraction unit is commanded by a central control and command unit.

4. Bending machine for a metal product, comprising a bending unit, a main drawing unit arranged to draw the metal product along an axis of advance toward said bending unit, and a main shearing unit disposed between said bending unit and said main drawing unit, said machine also comprising a secondary drawing or extraction unit disposed between said main drawing unit and said main shearing unit, said secondary drawing or extraction unit being configured and programmed to draw an end portion of the metal product exiting from said main drawing unit along said axis of advance toward said bending unit, and further comprising a secondary shearing unit of the bilateral type disposed between said secondary drawing or extraction unit and said main drawing unit;

wherein said bilateral shears comprise a pair of upper blades associated with respective lower blades, wherein a first upper blade is located on one side of the bilateral type shearing unit facing toward the main drawing unit, whereas a second upper blade is located on another side of the bilateral type shearing unit facing toward the secondary drawing or extraction unit;

wherein said upper blades are able to interfere with a first guide element for said metal product made in said secondary shearing unit of the bilateral type; and wherein said secondary drawing or extraction unit comprises at least a second guide element, the second guide element being substantially tubular and arranged to facilitate the advance of said metal product along said axis of advance.

5. Bending machine as in claim 4, wherein said second guide element comprises an entrance with an inclined profile to facilitate the entrance and advance of said metal product along said axis of advance.

6. Bending machine as in claim 4, wherein said secondary drawing or extraction unit includes a thrust means comprising rollers, and wherein second guide element has at least one aperture able to allow the cooperation between the thrust means of said secondary drawing or extraction unit and said metal product.

7. Method to bend metal products using a bending machine comprised of a bending unit, a main drawing unit, a main shearing unit disposed between said bending unit and said main drawing unit, and a secondary drawing or extraction unit disposed between said main drawing unit and said main shearing unit, and comprising the following steps:

a first step in which said main drawing unit draws a first one of the metal products along an axis of advance until said first one of the metal products exits from said main drawing unit, a second step in which only said secondary drawing or extraction unit draws said first one of the metal products along said axis of advance toward said bending unit for bending, a third step in which said main drawing unit draws a second one of the metal products along said axis of advance and toward said bending unit for bending, a fourth step in which said second one of the metal products thrusts said first one of the metal products along said axis of advance in order to discharge it from the axis of work of the bending machine.

8. Method as in claim 7, and further providing a step of head-wise or tail-wise butting of the first one and the second one of the metal products, performed by a secondary shearing unit of the bilateral type disposed between said secondary drawing or extraction unit and said main drawing unit.

* * * * *